US008231065B2

(12) United States Patent
Voorhis

(10) Patent No.: US 8,231,065 B2
(45) Date of Patent: Jul. 31, 2012

(54) FLOATING RESTRICTION FOR A REFRIGERANT LINE

(75) Inventor: Roger J. Voorhis, Clarksville, TN (US)

(73) Assignee: Trane International Inc., Piscataway, NJ (US)

( * ) Notice: Subject to any disclaimer, the term of this patent is extended or adjusted under 35 U.S.C. 154(b) by 1046 days.

(21) Appl. No.: 12/080,117

(22) Filed: Apr. 1, 2008

(65) Prior Publication Data

US 2009/0241568 A1 Oct. 1, 2009

(51) Int. Cl.
*G05D 23/00* (2006.01)

(52) U.S. Cl. ..... 236/51; 62/188; 62/218; 62/219; 62/220; 62/221; 62/225; 62/470; 62/471; 62/503; 236/65; 236/100

(58) Field of Classification Search ..... 62/188, 62/218–221, 225, 470, 471, 503; 236/52, 236/65, 100
See application file for complete search history.

(56) References Cited

U.S. PATENT DOCUMENTS 1,903,591 A * 4/1933 Haimbaugh et al. ..... 62/220
2,258,450 A * 10/1941 Graham ..... 137/154
2,568,711 A * 9/1951 Bosi ..... 62/192
3,033,005 A * 5/1962 Zearfoss, Jr. ..... 62/151
3,412,574 A 11/1968 Reiter
3,640,086 A * 2/1972 Brody ..... 62/210
3,871,187 A * 3/1975 Skvarenina ..... 62/196.1
5,076,066 A * 12/1991 Bottum ..... 62/126

* cited by examiner

*Primary Examiner* — Frantz Jules
*Assistant Examiner* — Azim Abdur Rahim
(74) *Attorney, Agent, or Firm* — William O'Driscoll

(57) ABSTRACT

A flow device for a refrigerant/compressor system is installed between the outlet of an evaporator and the suction port of a compressor. The device includes a floating element that helps inhibit liquid refrigerant from entering the compressor. Under certain conditions where liquid refrigerant discharges from the evaporator, the floating element floats in the discharged liquid. Upon doing so, the float rises to a generally closed position where the float obstructs a main fluid outlet that leads to the compressor. In the closed position, refrigerant can still pass through the flow device, but through a more restricted outlet. To prevent the float from undesirably rising under the impetus of refrigerant vapor flowing at high flow rates, the floating element itself includes a flow-restricting passageway, radial guides, and/or a streamlined shape. The float can be incorporated within a manifold of a multi-coil or multi-circuited heat exchanger.

14 Claims, 8 Drawing Sheets

FLOATING RESTRICTION FOR A REFRIGERANT LINE

FIELD OF THE INVENTION

The subject invention generally pertains to refrigerant systems and more specifically to a way of inhibiting liquid refrigerant from entering the suction inlet of a compressor.

BACKGROUND OF RELATED ART

Typical refrigerant systems include a compressor that compresses gaseous refrigerant received from an evaporator. Under certain conditions, such as during startup or transient operation, refrigerant might not fully vaporize in the evaporator, and thus the refrigerant might enter the compressor as a liquid, which can damage a compressor, particularly if the compressor is a positive displacement one.

To inhibit liquid refrigerant from entering a compressor, U.S. Pat. No. 3,412,574 suggests using a float valve between the evaporator and the compressor. The proposed valve includes a ball that is free to float loosely within a housing. When the housing is flooded with liquid refrigerant, the ball floats to block off a primary refrigerant outlet of the valve. In the absence of liquid, the intent is for the ball to fall back down away from the outlet to allow gaseous refrigerant to pass more freely through the housing.

If, however, the flow rate of the gaseous refrigerant is too great for the valve of the '574 patent, the gaseous refrigerant might create a velocity pressure sufficient to blow the ball upward until the ball blocks the outlet, even without liquid refrigerant. When the ball closes the outlet under such conditions, the gaseous flow becomes restricted, which could perhaps reduce the velocity pressure to a point where the ball falls back down. This would reopen the outlet, and the gaseous flow might once again blow the ball back up to obstruct the flow. If such a cycle were to repeat, the valve might begin hammering between open and closed positions.

For the valve of the '574 patent, it is also conceivable that once gaseous refrigerant blows the ball up against the outlet, the static pressure differential applied vertically across the ball might be sufficient to hold the ball in place. This might starve the compressor of refrigerant because only a restricted amount of gaseous refrigerant would be flowing through the small bypass opening of the valve.

Although these problems could be avoided by simply limiting the maximum flow rate of gaseous refrigerant through the valve, such a solution would also limit the cooling capacity of the refrigerant system over all. Consequently, there is a need for a better way of inhibiting liquid refrigerant from entering the suction inlet of a compressor.

SUMMARY OF THE INVENTION

It is an object of the invention to provide a float valve with ample space around its floating element to minimize gaseous pressure differentials that might adversely blow the floating element upward to its closed position.

Another object of some embodiments to provide a float with a restricted passageway that is vertically long and narrow to draw liquid refrigerant up from the bottom of a pool of liquid refrigerant. Thus, the passageway can effectively drain the liquid up from the bottom of the pool rather than releasing gaseous refrigerant from above the surface of the liquid pool.

Another object of some embodiments is to provide a float with guides that help maintain the float radially centered within a tubular housing.

Another object of some embodiments is to provide a float with guides that help maintain the float's proper orientation within a tubular housing.

Another object of some embodiments is to provide a floating element with a flow-restricting passageway therein for throttling the flow of refrigerant in the presence of liquid refrigerant.

Another object of some embodiments is to provide a float with a streamlined shape that minimizes the gaseous pressure drop across the float.

Another object of some embodiments is to incorporate a float within a manifold that is connected to a multi-coil heat exchanger.

One or more of these and/or other objects of the invention are provided by a flow device that includes a float that responds to liquid refrigerant yet is generally unresponsive to relatively high flow rates of gaseous refrigerant.

DESCRIPTION OF THE PREFERRED EMBODIMENT

Figure 1:
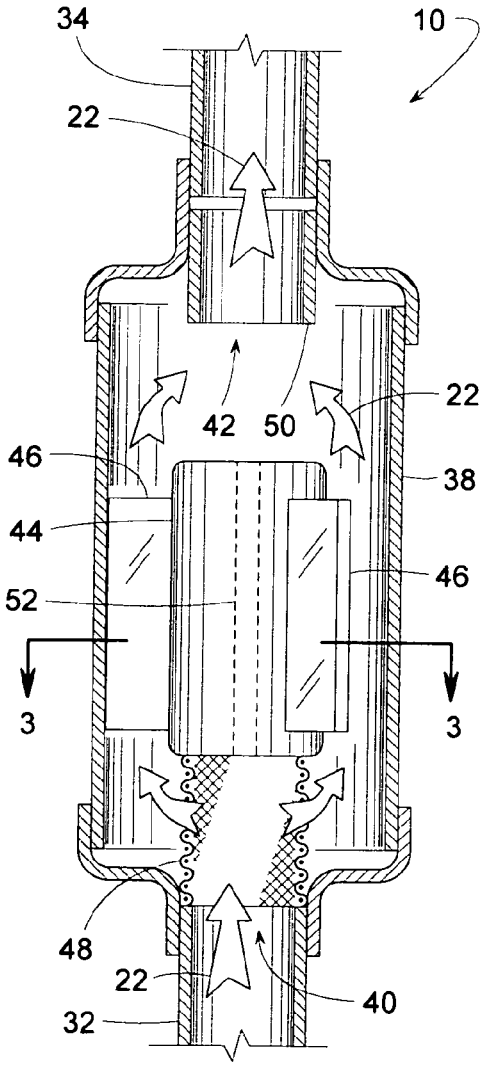
FIG. 1 is a cross-sectional side view of a flow device that inhibits liquid refrigerant from entering a compressor.
Figure 2:
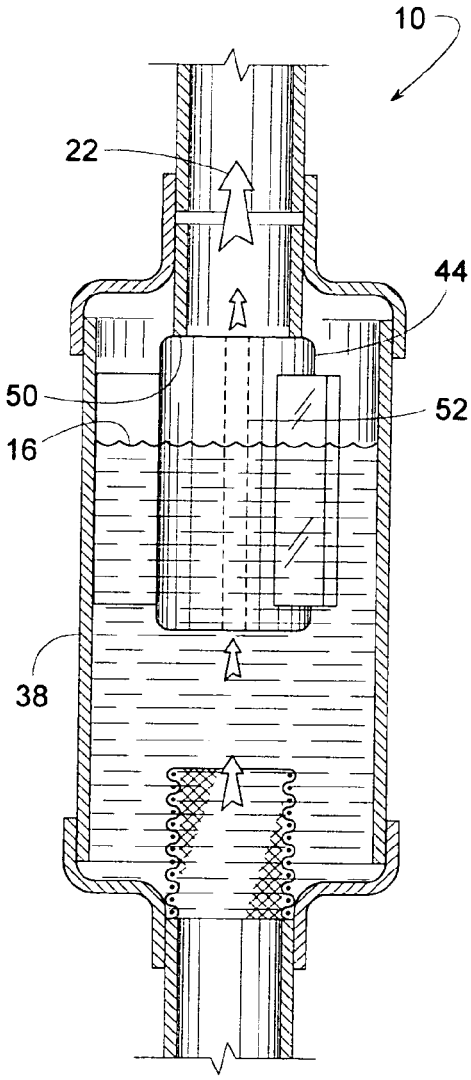
FIG. 2 is a cross-sectional view similar to FIG. 1 but with the device's float in a raised uppermost position.
Figure 3:
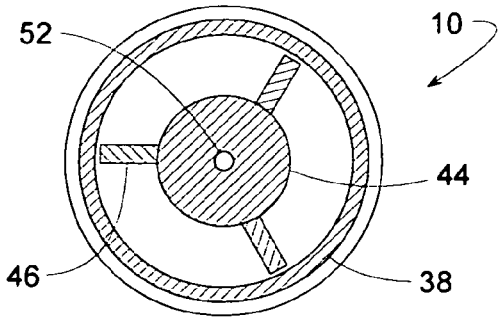
FIG. 3 is a cross-sectional view taken along line 3-3 of FIG. 1.
Figure 4:
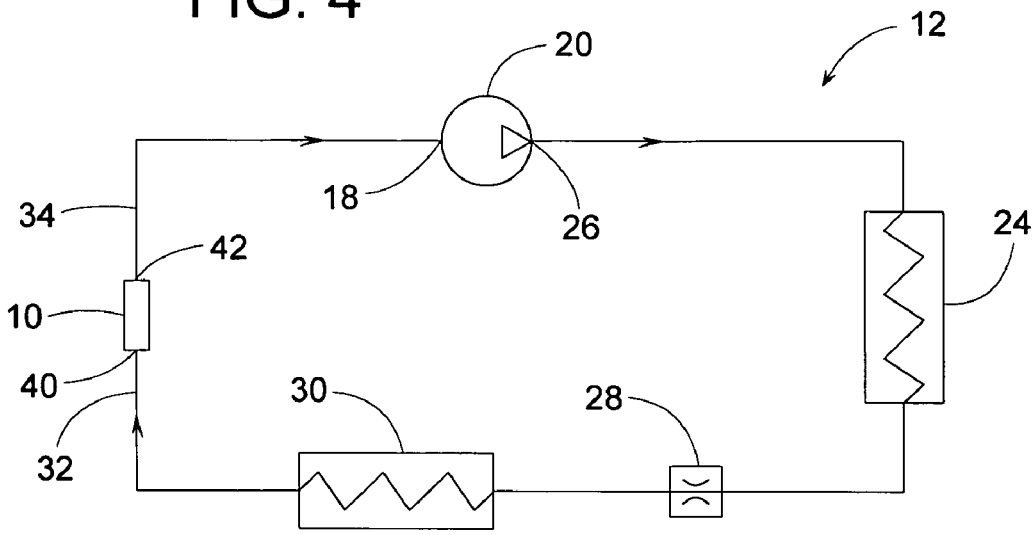
FIG. 4 is a schematic view of a refrigerant system incorporating the flow device of FIGS. 1-3.
Figure 5:
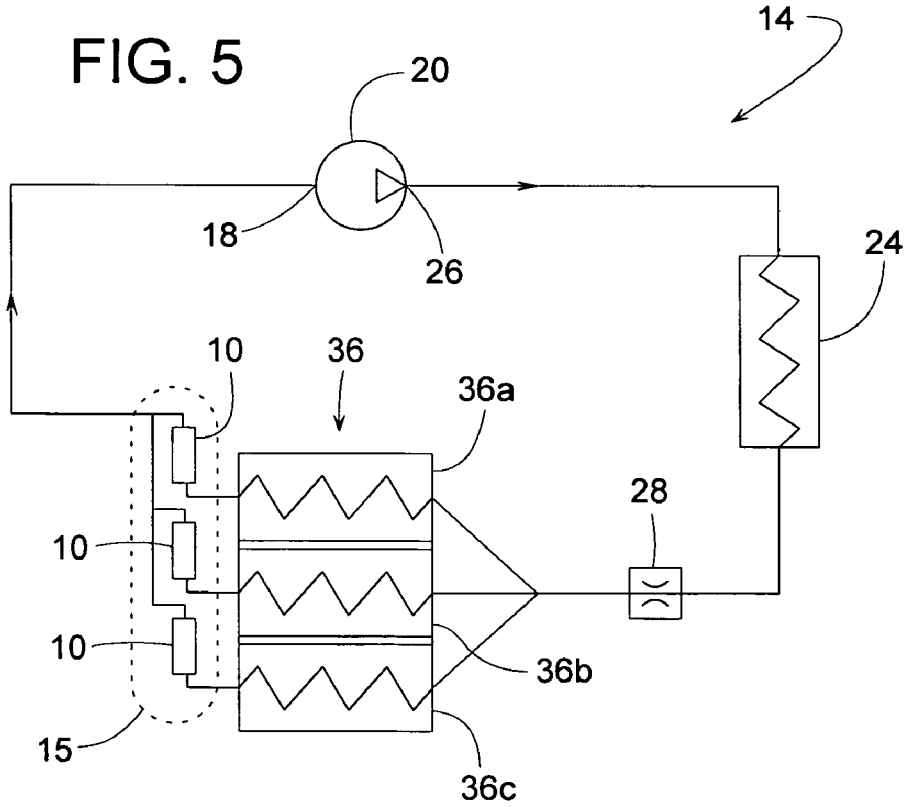
FIG. 5 is a schematic view of another refrigerant system incorporating the flow device of FIGS. 1-3.

FIGS. 1-3 illustrate a flow device 10 for virtually any refrigerant/compressor system, such as refrigerant system 12 of FIG. 4 or system 14 of FIG. 5, wherein device 10 helps inhibit liquid refrigerant 16 from entering a suction port 18 of the system's compressor 20.

In FIG. 4, refrigerant system 12 is schematically illustrated to comprise compressor 20 for compressing a gaseous refrigerant 22, a condenser 24 for cooling and condensing the refrigerant received from a discharge port 26 of compressor 20, an expansion device 28 (e.g., thermal expansion valve, electronic expansion valve, orifice, capillary, etc.) for expanding and thus further cooling the refrigerant discharged from condenser 24, an evaporator 30 for creating a cooling effect provided by the cooled refrigerant, and flow device 10 for returning refrigerant from evaporator 30 to suction port 18 of compressor 20. In some cases, flow device 10 is connected to evaporator 30 and suction port 18 via conduits 32 and 34 respectively.

Refrigerant system 14 of FIG. 5 is similar to system 12; however, evaporator 30 is replaced by an evaporator 36 that includes a plurality of coils, such as coils 36*a*, 36*b* and 36*c*. In this multi-coil example, expansion device 28 feeds refrigerant to each of coils 36*a*, 36*b* and 36*c*. Before the refrigerant returns to suction port 18 from evaporator 36, the refrigerant passes through a manifold 15 comprising a plurality of flow devices 10 corresponding to the plurality of coils 36*a*, 36*b* and 36*c*. The plurality of flow devices 10 can operate independently of each other. One flow device 10, for instance, might be freely conveying gaseous refrigerant from coil 36*a*, while another flow device 10 is restricting liquid refrigerant from coil 36*c*.

The actual design of flow device 10 may vary. In FIGS. 1-3, for example, device 10 comprises a housing 38 with an inlet 40 connected to conduit 32 and an outlet 42 connected to conduit 34. A float 44 is disposed within housing 38 such that float 44 can move between a lowered position (FIG. 1) and a raised uppermost position (FIG. 2). One or more guides 46 extending radially from float 44 can help maintain float 44 in its proper orientation within housing 38. In the lowered position of FIG. 1, float 44 rests upon a cylindrical screen 48. In the raised position, float 44 abuts a cylindrical valve seat 50.

Under normal operation, the refrigerant vaporizes completely within evaporator 30, thus gaseous refrigerant 22 leaves evaporator 30 and flows to suction port 18. This condition is illustrated in FIG. 1. The weight of float 44 causes float 44 to rest upon screen 48, and gaseous refrigerant 22 flows generally upward from conduit 32, outward through screen 48, upward around float 44 and between guides 46, and upward through seat 50 and conduit 34. When float 44 is in the lowered position of FIG. 1, gaseous refrigerant 22 can flow freely through flow device 10.

During certain operating conditions, however, the refrigerant within evaporator 30 does not vaporize completely, so evaporator 30 begins discharging liquid refrigerant 16 into flow device 10. This condition is illustrated in FIG. 2. When a certain amount of liquid refrigerant 16 enters housing 38, the liquid refrigerant 16 causes float 44 to float. Buoyancy holds float 44 up against seat 50, thereby partially obstructing the flow of refrigerant through device 10. A flow-restricting passageway 52, however, provides some restricted fluid communication between inlet 40 and outlet 42. In some cases, passageway 52 is simply a narrow bore through float 44. As liquid refrigerant 16 flows upward through passageway 52, the flow restriction of passageway 52 produces a pressure drop that helps vaporize the liquid refrigerant before it returns to suction port 18 of compressor 20. Thus, liquid refrigerant 16 is inhibited from entering compressor 20, yet device 10 does not completely starve compressor 20 of refrigerant.

Figure 6:
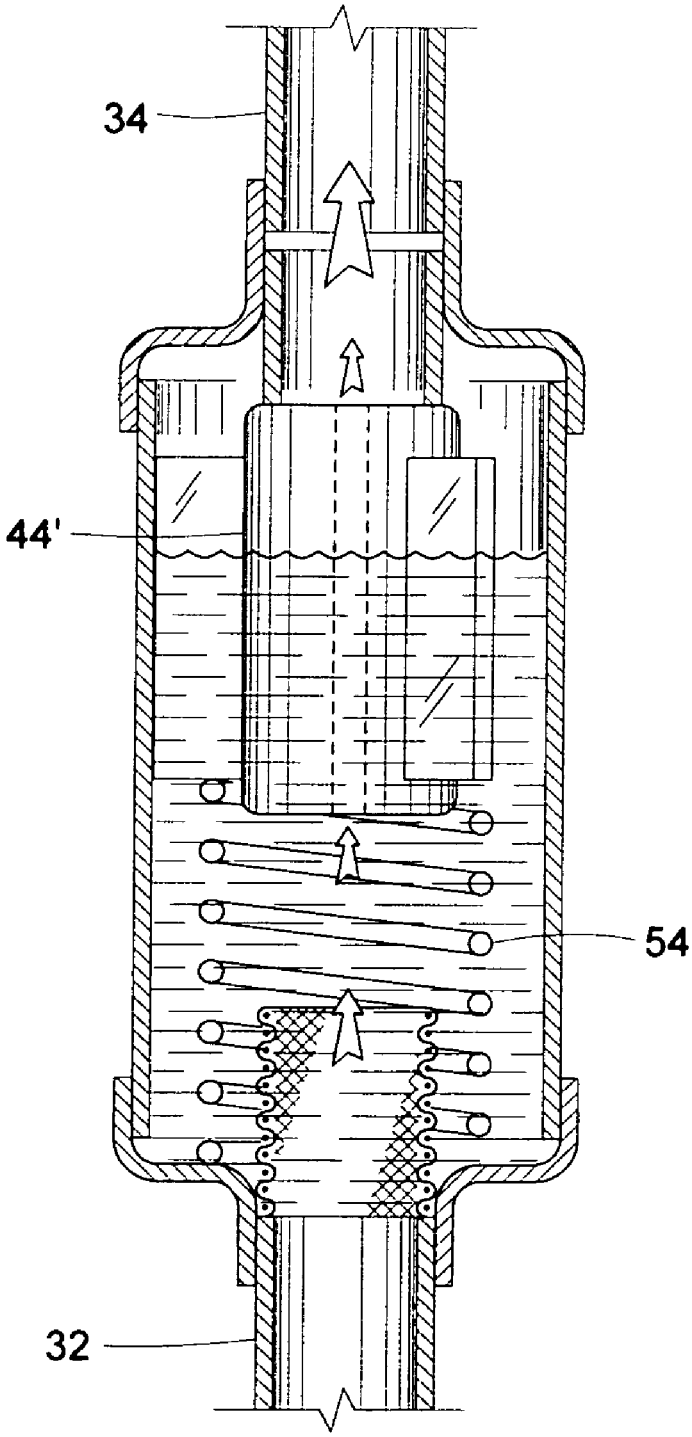
FIG. 6 is a cross-sectional view similar to FIG. 2 but showing an alternate flow device.

In some embodiments, float 44 has a lower density than liquid refrigerant 16. In other cases, however, a float 44' has a greater density but can still float with the support of a spring 54 that helps offset the float's weight, as shown in FIG. 6.

Figure 7:
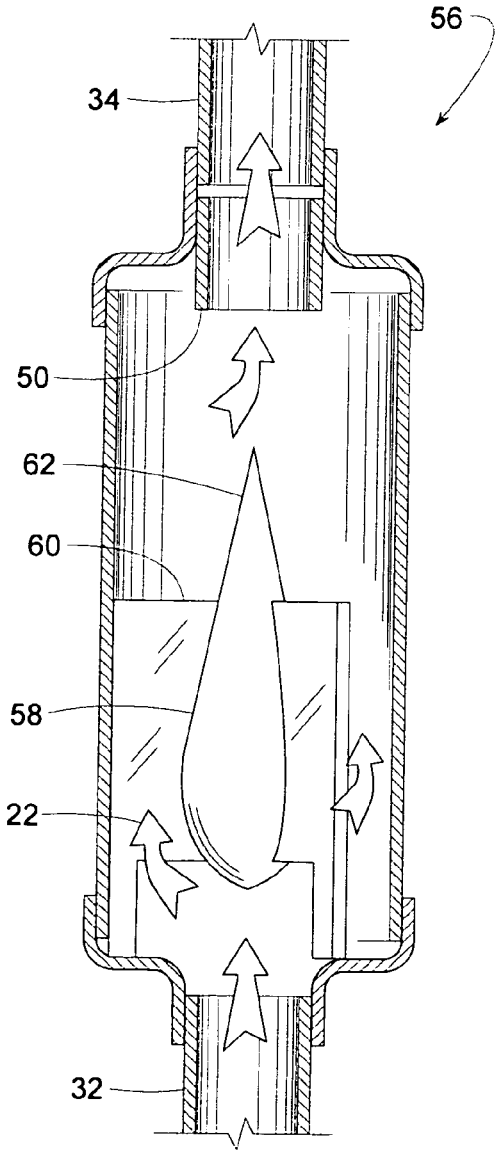
FIG. 7 is a cross-sectional view similar to FIG. 1 but showing another flow device.
Figure 8:
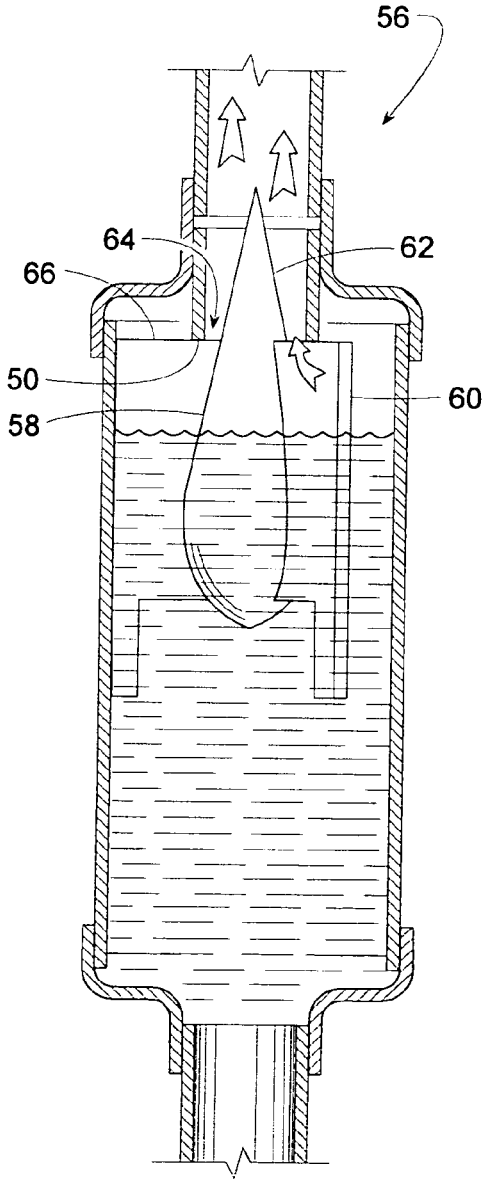
FIG. 8 is a cross-sectional view similar to FIG. 7 but with the device's float in a raised position.

In another embodiment, shown in FIGS. 7 and 8, a flow device 56 includes a more streamlined float 58. In the lowered position of FIG. 7, float 58 may provide less flow resistance to gaseous refrigerant 22. In the raised position of FIG. 8, radial guides 60 abut seat 50, and a tail section 62 of float 58 protrudes into seat 50 to create an appreciable flow-restricting annular passageway 64 between seat 50 and tail section 62. Passageway 64 provides reduced refrigerant flow with a significant pressure drop that helps avoid conveying liquid refrigerant to suction port 18 of compressor 20.

Figure 9:
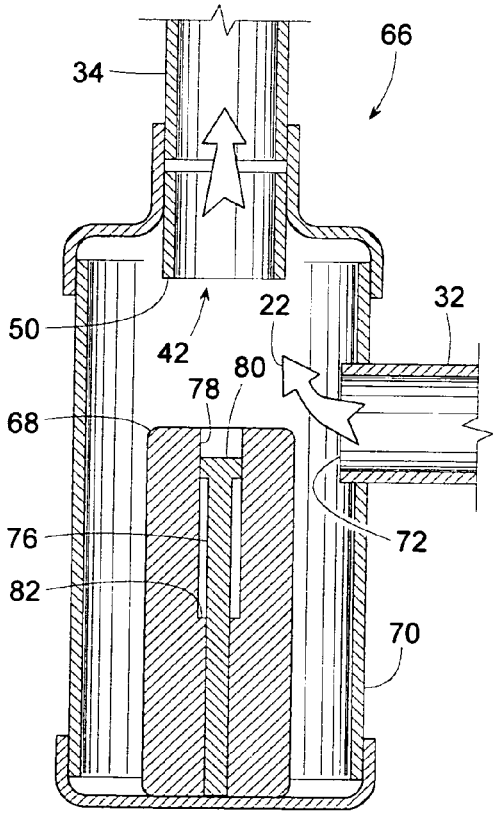
FIG. 9 is a cross-sectional view similar to FIG. 1 but showing yet another flow device.
Figure 10:
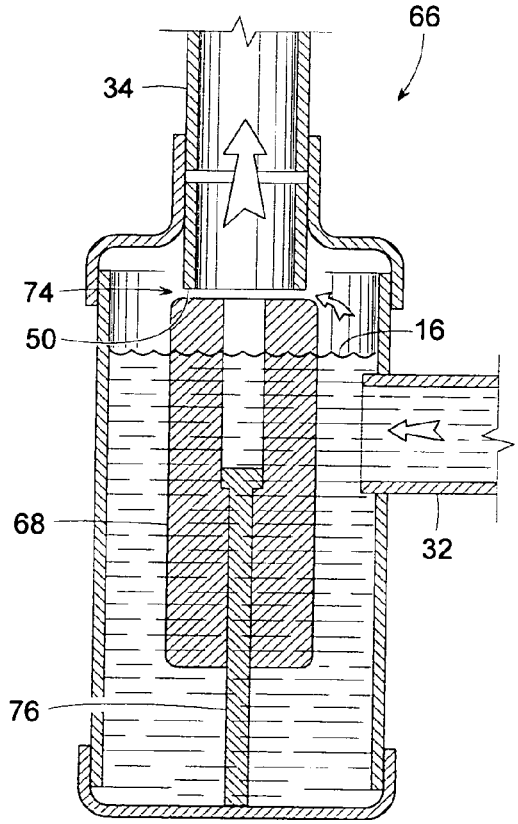
FIG. 10 is a cross-sectional view similar to FIG. 9 but with the device's float in a raised position.

In yet another embodiment, shown in FIGS. 9 and 10, a flow device 66 includes a float 68 that is situated within a housing 70 with a side inlet 72 so as to avoid obstructing the flow of gaseous refrigerant 22 flowing from inlet 72 to outlet 42 when float 68 is in the lowered position of FIG. 9. In the presence of liquid refrigerant 16, as shown in FIG. 10, float 68 floats to a raised position to partially obstruct the flow of refrigerant through device 66. A flow-restricting passageway 74 between float 68 and seat 50 produces a pressure drop that reduces the volumetric flow of liquid refrigerant and helps ensure the refrigerant vaporizes before it returns to suction port 18 of compressor 20.

With flow device 66, the vertical movement of float 68 is guided by a central pin 76 that extends slidingly into a bore 78 of float 68. To limit the upward movement of float 68 so as to create a properly sized passageway 74, pin 76 includes a head 80 that can engage a shoulder 82 of bore 78.

Figure 11:
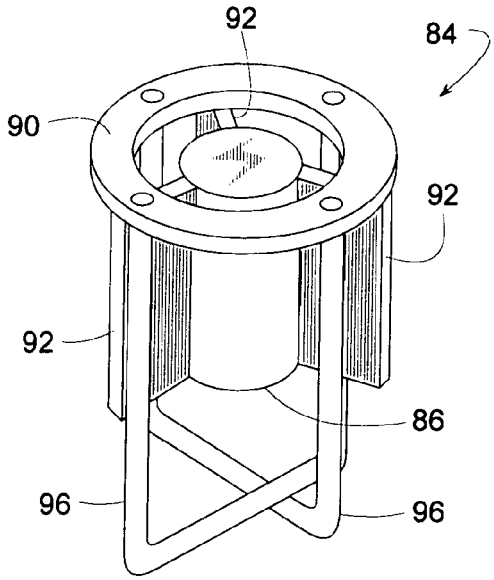
FIG. 11 is a perspective view of another flow device with a float.
Figure 12:
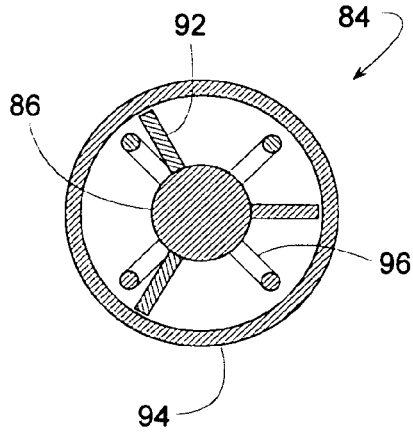
FIG. 12 is a cross-sectional view taken along line 12-12 of FIG. 13.
Figure 13:
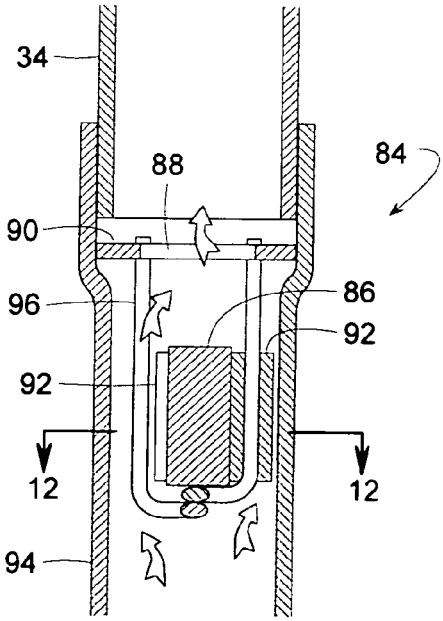
FIG. 13 is a cross-sectional side view of the flow device of FIG. 11 installed within a tubing assembly.
Figure 14:
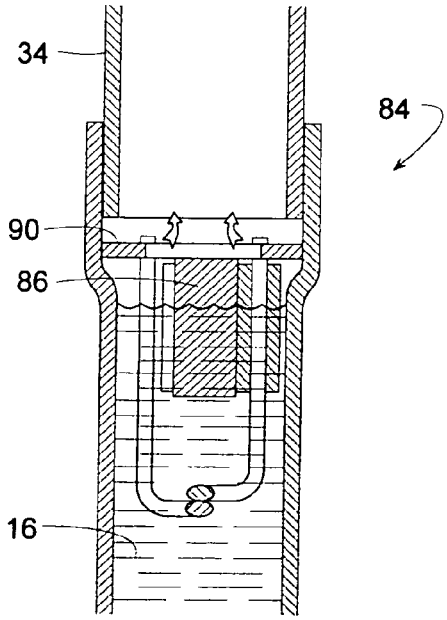
FIG. 14 is a cross-sectional side view similar to FIG. 13 but showing the float in a raised position rather than a lowered position.

FIGS. 11-14 show a flow device 84 comprising a float 86 that in the presence of liquid refrigerant 16 floats from a lowered position (FIG. 13) to a raised position (FIGS. 11 and 4). In the lowered position, refrigerant can flow freely around float 86 and up through a central opening 88 of an upper ring 90. Upon floating to the raised position, float 86 in proximity with ring 90 creates a significant flow restriction at opening 88 (between float 86 and ring 88). The flow restriction reduces the volumetric flow of liquid refrigerant and helps ensure liquid refrigerant vaporizes before conduit 34 conveys the refrigerant to the suction port of a compressor. Fins 92 extending from float 86 and slidingly engaging a tube 94 help maintain float 86 in radial alignment with opening 88 of ring 90. Fins 92 abutting the lower surface of ring 90 limits the upper travel of float 86. A wire cage 96 extending from ring 90 provides a lower end stop for float 86.

Figure 15:
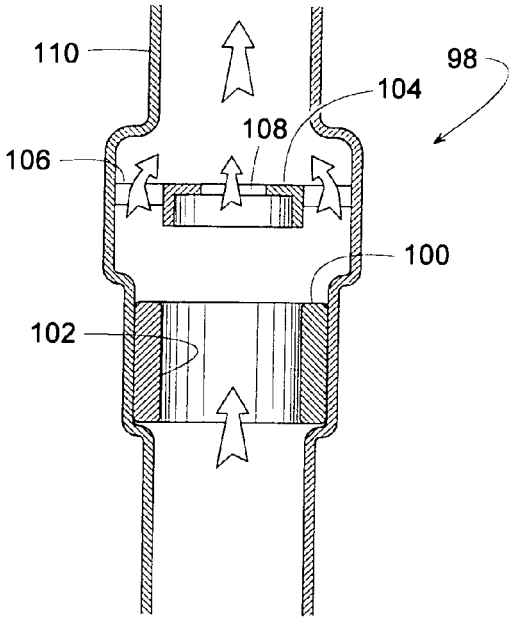
FIG. 15 is a cross-section side view of another flow device with its float in a lowered position.
Figure 16:
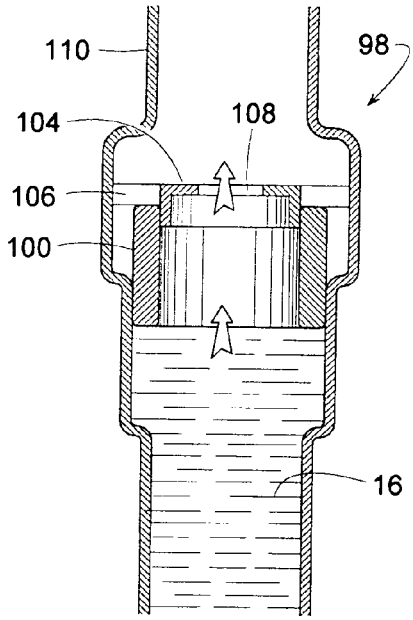
FIG. 16 is a cross-sectional side view similar to FIG. 15 but showing the float in a raised position.

FIGS. 15 and 16 show a flow device 98 comprising a tubular float 100 that in the presence of liquid refrigerant 16 floats from a lowered position (FIG. 15) to a raised position (FIG. 16). In the lowered position, refrigerant flows freely through a central bore 102 of float 100 and then flows upward through and around an orifice ring 104 that is held in place via radial fins 106. In the raised position, float 100 obstructs the flow path around the outer perimeter of ring 104, thereby leaving just a restricted flow path through a central aperture 108 of ring 104. The restriction of ring 104 reduces the volumetric flow of liquid refrigerant and helps ensure liquid refrigerant vaporizes before a suction line 110 conveys the refrigerant to the suction port of a compressor.

It should be noted that each of the aforementioned flow devices provides an open cross-sectional flow area when its float is in the lowered position and provides a restricted cross-sectional flow area when in the raised uppermost position. In currently preferred embodiments, a ratio of the open cross-sectional flow area to the restricted cross-sectional flow area is between three and seven.

Figure 17:
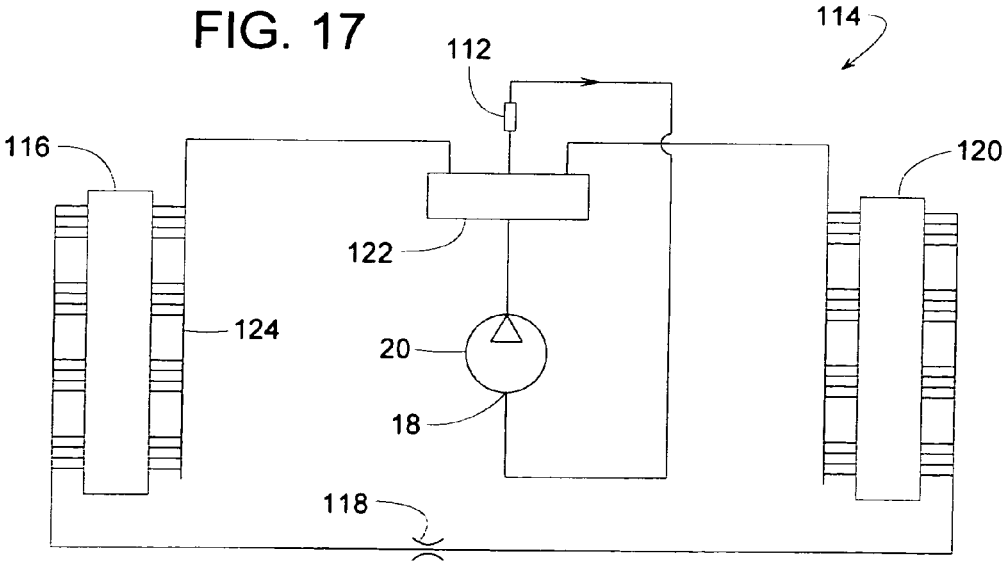
FIG. 17 is a schematic view of a heat pump system with a flow device according to the subject invention.

FIG. 17 shows how a flow device 112 (schematically representing any of the flow devices already disclosed herein) can be incorporated in a reversible heat pump system 114. In this example, system 114 comprises refrigerant compressor 20; a multi-coil indoor heat exchanger 116 (evaporator or condenser); an expansion device 118; a multi-coil outdoor heat exchanger 120 (evaporator or condenser); and a conventional 4-way, 2-position reversing valve 122 for selective heating or cooling operation. The structure and function of heat pump systems for heating or cooling is well known to those of ordinary skill in the art. For the system illustrated in FIG. 17, flow device 112 helps prevent liquid refrigerant from entering suction port 18 of compressor 20 regardless of whether system 114 is operating in the cooling or heating mode.

Figure 18:
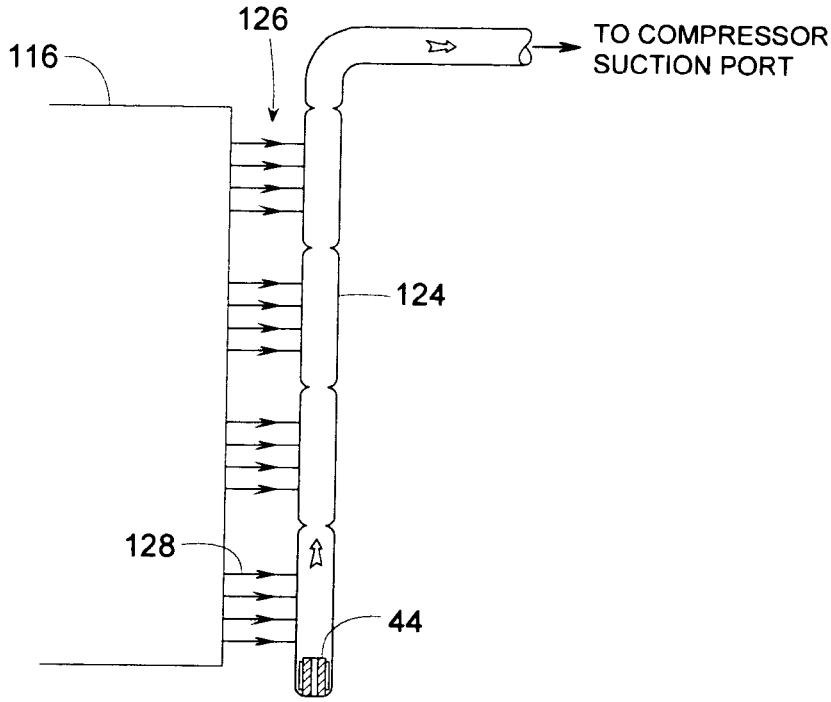
FIG. 18 is a cross-sectional side view of a float incorporated within a manifold of a multi-coil heat exchanger.
Figure 19:
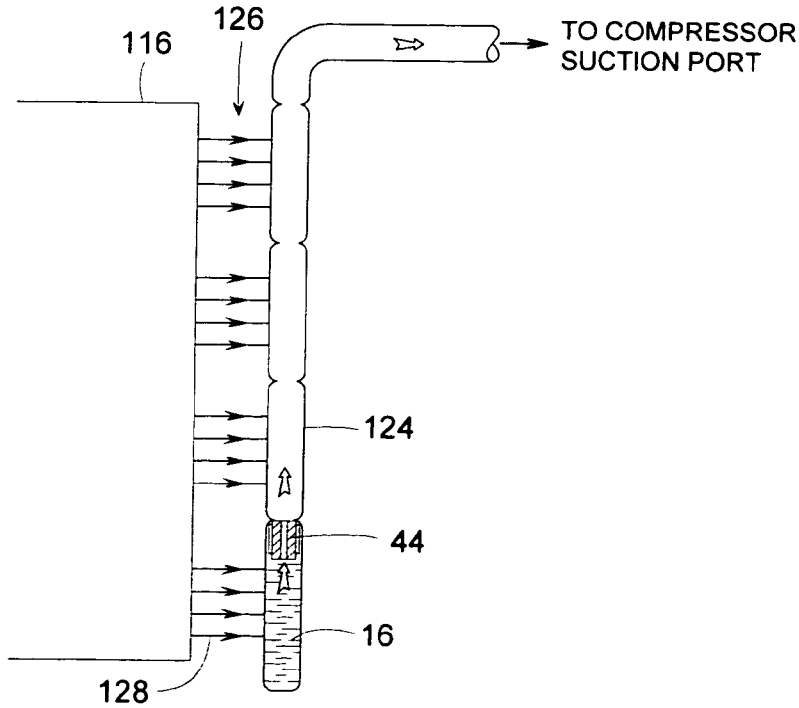
FIG. 19 is a cross-sectional side view similar to FIG. 18 but showing the float in a raised position rather than a lowered position.

FIGS. 18 and 19 show an alternate location for float 44. In this example, float 44 is installed within a manifold 124 connected to the downstream side of a multi-coil heat exchanger, such as heat exchanger 116 operating as an evaporator. A plurality of tubes 126 conveys refrigerant from the various coils of heat exchanger 116 and discharges the refrigerant into manifold 124. From there the refrigerant flows to the suction port of a compressor. If one or more of the lower tubes 128 feed liquid refrigerant 16 into manifold 124, float 44 floats upward from its lowered position of FIG. 18 to its raised position of FIG. 19. Upon doing so, float 44 creates a flow restriction similar to that of FIGS. 1 and 2. Note, multiple floats 44 can be used in the multi-circuit configuration, only one is shown in FIG. 19. The flow restriction reduces the volumetric flow of liquid refrigerant and helps vaporize the liquid refrigerant before the refrigerant returns to compressor 20.

Although the invention is described with respect to a preferred embodiment, modifications thereto will be apparent to those of ordinary skill in the art. The scope of the invention, therefore, is to be determined by reference to the following claims:

The invention claimed is:

1. A refrigerant system for handling a refrigerant, comprising:

a compressor that includes a discharge port and a suction port;

a condenser connected to receive the refrigerant from the discharge port of the compressor;

an expansion device connected to receive the refrigerant from the condenser;

an evaporator connected to receive the refrigerant from the expansion device;

a flow device comprising a housing that defines an inlet for receiving the refrigerant from the evaporator and an outlet for releasing the refrigerant to the suction port of the compressor, the flow device includes a float disposed within the housing, the float moves from a lowered position to a raised uppermost position in response to a certain amount of liquid refrigerant being inside the housing, the float in the raised uppermost position engaging a hard stop and defining a restricted cross-sectional flow area, the float in the lowered position defining an open cross-sectional flow area, wherein the open cross-sectional flow area is between three and seven times greater than the restricted cross-sectional flow area such that the float provides the flow device with greater refrigerant flow resistance when the float is in the raised uppermost position than when the float is in the lowered position, and wherein the inlet and the outlet remain in fluid communication with each other to enable refrigerant flow through the housing regardless of whether the float is in the raised uppermost position or the lowered position; and a guide in sliding contact with at least one of the float and the housing to help guide the float as the float moves between the raised uppermost position and the lowered position.

2. The refrigerant system of claim 1, further comprising a valve seat disposed within the housing such that the float approaches the valve seat as the float moves from the lowered position to the raised uppermost position, wherein the float and the valve seat define an appreciable flow-restricting passageway therebetween when the float is in the raised uppermost position.

3. The refrigerant system of claim 1, wherein the float being in the raised uppermost position creates a flow restriction that helps cause the certain amount of liquid refrigerant to vaporize upon flowing from the inlet to the outlet.

4. The refrigerant system of claim 1, wherein the refrigerant in a liquid state has a greater density than that of the float.

5. The refrigerant system of claim 1, further comprising a spring urging the float upward, whereby the float has a greater tendency to float.

6. The refrigerant system of claim 1, further comprising a plurality of floats that includes the float, wherein the evaporator comprises a plurality of coils in correspondence with the plurality of floats.

7. A refrigerant system for handling a refrigerant, comprising:

a compressor that includes a discharge port and a suction port;

a condenser connected to receive the refrigerant from the discharge port of the compressor;

an expansion device connected to receive the refrigerant from the condenser;

an evaporator connected to receive the refrigerant from the expansion device; and a flow device comprising a housing that defines an inlet for receiving the refrigerant from the evaporator and an outlet for releasing the refrigerant to the suction port of the compressor, the flow device includes a float and a valve seat disposed within the housing such that:

a) the float moves from a lowered position to a raised uppermost position in response to a certain amount of liquid refrigerant being inside the housing, b) the refrigerant in a liquid state has a greater density than that of the float, c) the float provides the flow device with greater refrigerant flow resistance when the float is in the raised uppermost position than when the float is in the lowered position, d) the inlet and the outlet remain in fluid communication with each other to enable refrigerant flow through the housing regardless of whether the float is in the raised uppermost position or the lowered position, e) the float defines a flow-restricting passageway therethrough such that when the float is in the raised uppermost position the flow-restricting passageway creates a pressure differential that helps cause the certain amount of liquid refrigerant to vaporize upon flowing from the inlet to the outlet, and f) the flow device provides an open cross-sectional flow area when the float is in the lowered position, and the flow device provides a restricted cross-sectional flow area when the float is in the raised uppermost position engaging the valve seat, wherein a ratio of the open cross-sectional flow area to the restricted cross-sectional flow area is between three and seven.

8. The refrigerant system of claim 7, further comprising a guide in sliding contact with at least one of the float and the housing to help guide the float as the float moves between the raised uppermost position and the lowered position.

9. The refrigerant system of claim 7, further comprising a valve seat disposed within the housing such that the float approaches the valve seat as the float moves from the lowered position to the uppermost position, wherein the float and the valve seat define an appreciable flow-restricting passageway therebetween when the float is in the raised uppermost position.

10. The refrigerant system of claim 7, further comprising a spring urging the float upward, whereby the float has a greater tendency to float.

11. The refrigerant system of claim 7, further comprising a plurality of floats that includes the float, wherein the evaporator comprises a plurality of coils in correspondence with the plurality of floats.

12. A refrigerant system for handling a refrigerant, comprising:

a compressor that includes a discharge port and a suction port; a condenser connected to receive the refrigerant from the discharge port of the compressor;

an expansion device connected to receive the refrigerant from the condenser;

an evaporator connected to receive the refrigerant from the expansion device;

a manifold connected to convey the refrigerant to the suction port of the compressor;

a plurality of tubes connected to convey the refrigerant from the evaporator to the manifold; and a float disposed within the manifold, the float moves from a lowered position to a raised uppermost position engaging a hard stop in response to a certain amount of liquid refrigerant being inside the manifold, the float provides at least part of the manifold with greater refrigerant flow resistance when the float is in the raised uppermost position than when the float is in the lowered position wherein refrigerant flows past the float when the float is in the raised uppermost position.

13. The refrigerant system of claim 12, wherein the float moving between the raised uppermost position and the lowered position affects flow through one tube of the plurality of tubes more than others.

14. The refrigerant system of claim 13, wherein the one tube is the lowest of the plurality of tubes.

* * * * *